United States Patent [19]

Wall

[11] Patent Number: 4,488,462

[45] Date of Patent: Dec. 18, 1984

[54] SCREWDRIVER WITH DUAL TIP

[76] Inventor: Stanford J. Wall, 751 E. Dalton Ave., Glendora, Calif. 91740

[21] Appl. No.: 319,194

[22] Filed: Nov. 9, 1981

[51] Int. Cl.[3] ..... B25B 15/00

[52] U.S. Cl. ..... 81/439; 81/438; 81/460

[58] Field of Search ..... 81/439, 442, 460, 438, 81/437, 436

[56] References Cited

U.S. PATENT DOCUMENTS

| | | | |
|---|---|---|---|
| 1,345,708 | 7/1920 | Schneider . | |
| 1,501,222 | 7/1924 | Lamp | 81/439 |
| 2,116,775 | 5/1936 | Blackburn . | |
| 2,522,996 | 9/1950 | Cone . | |
| 2,546,489 | 3/1951 | Wright . | |
| 3,674,070 | 7/1972 | Mahoney . | |
| 4,328,721 | 5/1982 | Massari | 81/439 |

FOREIGN PATENT DOCUMENTS

| | | | |
|---|---|---|---|
| 2049435 | 4/1972 | Fed. Rep. of Germany | 81/439 |

*Primary Examiner*—Frederick R. Schmidt
*Assistant Examiner*—Steven P. Schad
*Attorney, Agent, or Firm*—Christie, Parker & Hale

[57] ABSTRACT

A screwdriver is provided that can be used for installing and removing either single slot screws or screws having two slots that cross at their centers, i.e., "PHILLIPS" type screws. The screwdriver is provided with a shaft which includes a tip segment having a configuration suited for engagement in the slots of such a cross-slotted screw. An elongated slot is in the tip segment along the length of the shaft. A blade, suited for engagement in the slot of a single slot screw, is slidably mounted in the tip segment slot. When the blade is in a first position extended beyond the end of the shaft tip segment, it can be engaged in the slot of such a single slot screw. When the blade is in a second position retracted or housed within the elongated tip segment slot, the tip segment can be engaged in the slots of such a cross-slotted screw.

13 Claims, 7 Drawing Figures

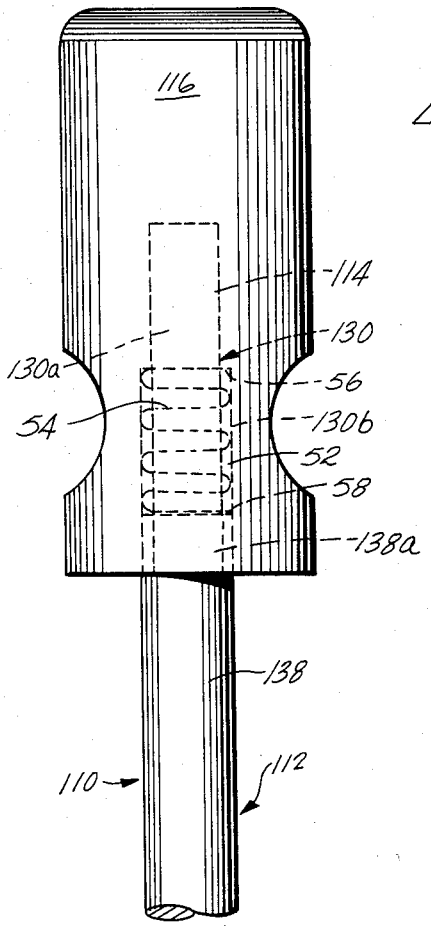
FIG. 6
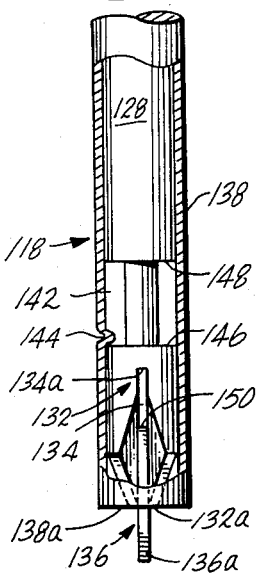
FIG. 7
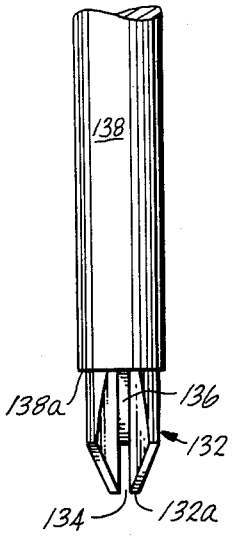

SCREWDRIVER WITH DUAL TIP

FIELD OF THE INVENTION

This invention relates to a screwdriver that is useful for installing and removing two basic types of screw fasteners: those having heads with single slots and those having heads with two slots that cross at their centers.

BACKGROUND OF THE INVENTION

As is well known, screws can have heads with various design configurations. Two of the most common screw head types or designs are: those having a single straight slot and those having two slots that cross at about their centers. As used herein, a screw having a single straight slot in its head is called a "standard" screw and a screw having two crossing slots is called a "PHILLIPS" head or cross-slotted screw. "PHILLIPS" is a trademark of Phillips Screw Company of Natick, Mass.

A "PHILLIPS" head or "PHILLIPS" type screwdriver is required for installing and removing such a "PHILLIPS" screw while, on the other hand, a standard screwdriver, i.e., one having a single straight blade, is required for installing and removing such a "standard" screw. Thus, a workman must take both standard and "PHILLIPS" screwdrivers with him to the job site because he can never be sure which type of screw fastener he will encounter. He may, in fact, encounter both types.

Thus, there is a need for an economical and practical screwdriver that can be used for installing and removing both "PHILLIPS" type and "standard" screws.

One attempt to solve this problem has been to provide a screwdriver with a single shaft having a "PHILLIPS" type tip on one end, a flat blade on the other end, and a handle in about the middle.

Such a screwdriver may not be desirable, however, because the handle is not positioned for optimum effectiveness when either installing or removing a screw. For instance, it may not be possible for a workman to exert a desired amount of force along the shaft axis when using the above described screwdriver because of the handle position. Additionally, screwdrivers having this design are not as convenient as desired because presently available tool belts do not accommodate them.

Another attempt to solve the problem has been to provide a screwdriver having a single handle with a plurality of removable tips of different designs. Thus, for example, one of such tips can be used for "PHILLIPS" type screws, while another one of the tips can be used for "standard" screws.

This may not be satisfactory, however, because the removable tips can be misplaced and lost. Additionally, the mechanism for holding the tips in the handle can be fairly cumbersome and it can take longer than desired to switch from one style of tip to another.

There are also several U.S. patents which disclose screwdrivers designed for use on more than one style of screw fastener. For example, U.S. Pat. No. 2,116,775 to G. P. Blackburn discloses a screwdriver which ". . . may serve either in the capacity of an ordinary screwdriver applicable for single straight slotted screws, or for use with screws having cross-shaped slotted heads." Blackburn discloses that his device comprises four separate bits which are movable relative to each other and which can either be useful for operating on a single slot or cross-slotted screw. All four bits are mounted in and extend from the screwdriver handle. When the bits are fully extended, they form a cross and thus can engage a cross-slotted screw. When, however, a screw having a single slot is encountered, two of the bits opposite from each other can be moved into the handle a greater distance than the other two bits so that the bits that remain fully extended form a single "blade". These two bits or single "blade" can then engage the slot of the single slot screw.

When a screwdriver is used which has a design similar to that disclosed by Blackburn, the same bits that are used for straight slotted screws are also used for cross-slotted screws. This may not be desirable because normally the slot in a "standard" screw is shaped differently from either of the slots in a cross-slotted screw. For instance, normally the slot in a "standard" screw is flat at its bottom while the slots in a "PHILLIPS" type screw taper toward the center of the screw. Therefore, the bits or blades of a device similar to that of Blackburn are not optimally shaped for best engagement with both screw types. Additionally, it is disclosed that a pin must be removed and reinstalled each time the bits are moved to a different position. This can take an undesirable amount of time and there is a possibility that the pin can be lost. Further, since the bits are not fixed permanently in the handle, the bits can be lost.

U.S. Pat. No. 2,522,996 to J. H. Cone discloses a ". . . universal screwdriver having bit means adapting it for use with either slotted or recessed screw heads." The screwdriver disclosed by Cone has an integral blade suitable for use with conventional slotted head type screws. An adapter bit designed for use on various types of recessed head screws can be mounted onto the conventional blade.

Thus, since the adapter bit disclosed by Cone is not permanently connected to the screwdriver, there is the possibility that it can be lost.

U.S. Pat. No. 3,674,070 to Mahoney discloses a hand tool having the capability to engage various types and sizes of screw fastener heads. The hand tool disclosed in this patent comprises a bundle of wires held in a generally tubular housing with one end of the bundle projecting slightly beyond the end of the housing. The other end of the bundle presses against a deformable cell located in the housing. A handle is attached to the other end of the housing. When the projecting wires are pressed against the head of a screw fastener, the wires deform, making a replica mold of the surface of the screw head, wherein some of the wires move into the slot or slots in the head. Thus, a "blade" comprising a plurality of wires extends into either the single slot of a "standard" screw or the cross-slots of a "PHILLIPS" type screw.

There remains a need in the art, however, for an economical, easy to use, reliable screwdriver that has both a single blade specifically designed for use on a "standard" screw and additionally a "PHILLIPS" head tip for use on a "PHILLIPS" or cross-slotted screw, where all of the screwdriver components are permanently connected together.

SUMMARY OF THE INVENTION

This invention relates to a screwdriver of simple construction provided in one integral unit for use both on "standard" screws and on cross-slotted or "PHILLIPS" head screws. The screwdriver comprises a handle and a uniquely designed shaft assembly comprising an elongated shaft having one end mounted securely to the handle. The other end of the shaft comprises a tip segment having a configuration suited for engagement in the slots of a cross-slotted screw. An elongated slot is in the shaft tip segment and extends from the distal end of the tip segment along at least a portion of its length. The shaft assembly also comprises a blade having a leading edge portion for engagement in the slot of a "standard" screw slidably mounted in the elongated slot in the shaft tip segment. The leading edge portion of the blade is in a first position, extended beyond the end of the shaft tip segment when it is engaged in the slot of such a "standard" screw. The leading edge portion of the blade is in a second position, retracted or housed within the elongated slot in the shaft tip segment, when the tip segment is engaged in the slots of such a cross-slotted screw.

The screwdriver of this invention has no removable parts that can be lost and, in an instant, by simply changing the position of the blade, it can be used for installing or removing either of the two basic screw types described above.

DRAWINGS

These and other features, aspects, and advantages of the present invention will be more fully understood when considered with respect to the following detailed description, appended claims, and accompanying drawings wherein:

FIG. 6 is a fragmentary, partially cut away side elevational view of another preferred embodiment of a screwdriver provided in accordance with practice of principles of this invention in its configuration for operation on a single slot screw; and FIG. 7 is a fragmentary side elevational view of the screwdriver shown in FIG. 6 in its configuration for operation on a cross-slotted screw.

DETAILED DESCRIPTION

Figure 1:
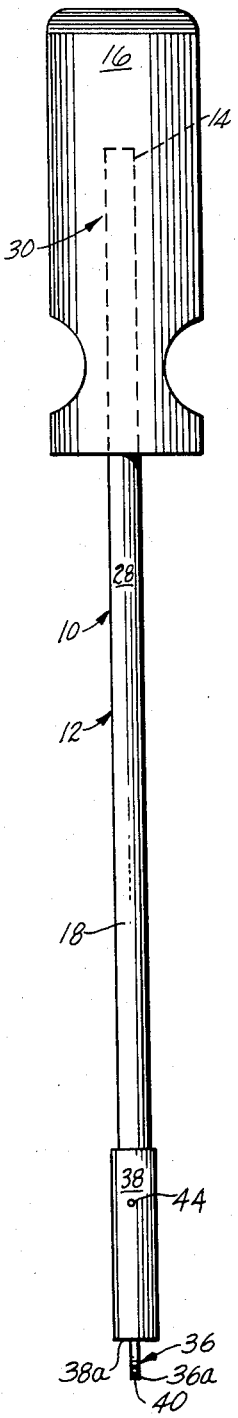
FIG. 1 is a side elevational view of a preferred embodiment of a screwdriver provided in accordance with practice of this invention in its configuration for operation on a single slot or "standard" screw.
Figure 2:
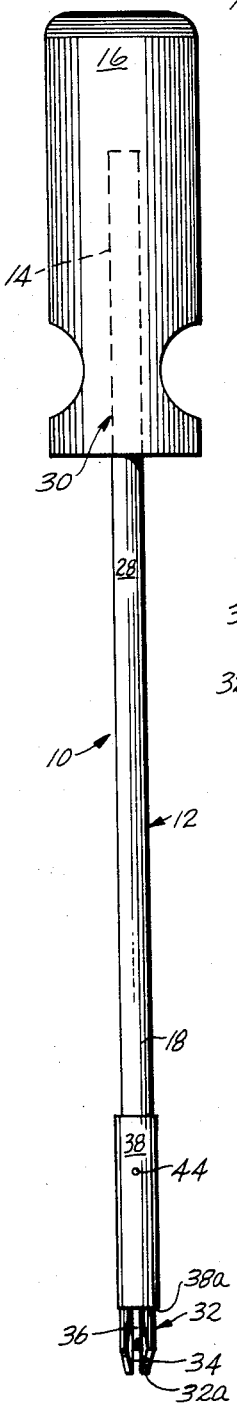
FIG. 2 is a side elevational view of the screwdriver shown in FIG. 1 in its configuration for operation on a cross-slotted or "PHILLIPS" head type screw.

Referring to FIGS. 1–5, there is shown a preferred embodiment of a screwdriver 10 provided in accordance with practice of this invention.

The screwdriver 10 comprises an elongated shaft assembly 12 having two ends; a first end 14 connected permanently to a handle 16 and a second end 18 remote from the handle.

The shaft assembly 12 performs a dual function. When the assembly is in a first configuration (best seen in FIGS. 1 and 4), it can engage the single slot 20 of a "standard" screw 22. Alternatively, when the assembly is in its second configuration (best seen in FIGS. 2 and 5), it can engage the slots 24 of a cross-slotted or "PHILLIPS" head screw 26. Thus, the screwdriver 10 is useful for installing and removing both "standard" and "PHILLIPS" head screws or fasteners.

The components of the shaft assembly 12, which are described below in detail, are preferably steel or the like, but other suitable materials can be used if desired. The handle 16 can be any material commonly used for screwdriver handles; for example, wood or plastic.

The shaft assembly includes an elongated steel shaft 28 which is preferably cylindrical. Shafts having other shapes can be used, however, if desired.

One end of the shaft 28 comprises the first end 14 of the shaft assembly 12 and thus, is connected to the handle 16. In this embodiment, the end 14 of the shaft is connected in an elongated cylindrical recess 30 in the handle along the handle axis.

The end of the shaft 28 remote from the handle comprises a tip segment or tip 32. The tip 32 is that portion of the second end 18 of the shaft assembly that engages the slots in a "PHILLIPS" head screw, such as the screw 26, when the assembly is in its second configuration. Preferably, the shaft 28, including the tip segment 32, is of one piece construction.

An elongated slot 34 (see FIGS. 2–5) is in the shaft tip segment 32 and extends from the distal end **32*a*** of the tip along its length. The slot is in a plane about parallel to the axis of the shaft and is through about the center of the shaft.

The shaft assembly additionally comprises a blade 36 which is slidably mounted in the elongated slot 34. The blade is provided for engaging the single slot in a "standard" screw fastener, such as the screw 22, when the shaft assembly is in its first configuration.

In the preferred embodiment, the blade 36 is carried in an elongated, hollow, cylindrical sleeve 38 which is open at both ends. Although a cylindrical sleeve is preferred, sleeves having other shapes can be used, depending, for example, on the shape of the shaft.

The blade is fixedly connected across the distal opening or end **38*a* of the sleeve and the sleeve is slidably mounted on the shaft 28 for movement along the length of the shaft. When the blade is in place in the sleeve, its leading edge portion 36*a* extends beyond the distal sleeve opening 38*a*** at least a sufficient distance to allow it to bottom in the slot of a screw.

In a working embodiment, the blade is permanently fixed to the sleeve by press fitting such a blade, having a width slightly larger than the internal diameter of the sleeve, into the sleeve. In this embodiment, the blade extended about 0.1 inches beyond the distal end of the sleeve. If desired, however, the blade can extend more or less than 0.1 inches from the end of the sleeve and can be fixed to the sleeve by other methods such as by adhesive bonding or welding or the like.

When the screwdriver is assembled with the blade 36 in the sleeve 38 and the sleeve on the shaft, the screwdriver is ready to be used.

As described above, the screwdriver shaft assembly 12 has two configurations; one for installing and removing "standard" screws and one for installing and removing "PHILLIPS" head screws.

Figure 4:
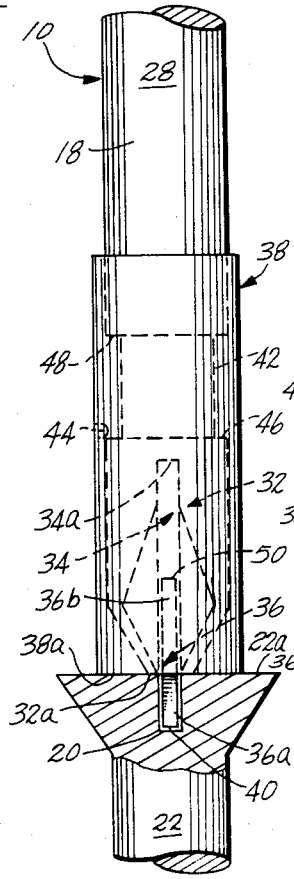
FIG. 4 is a fragmentary, semi-schematic side elevational view of the screwdriver of FIGS. 1 and 2 (in the configuration shown in FIG. 1) with its blade engaged in the slot of a "standard" screw.

When it is desired to place the shaft assembly 12 in its configuration for use on standard screws, as shown in FIGS. 1 and 4, the sleeve 38 is moved down the shaft away from the handle. This places the leading edge portion **36*a* of the blade beyond the distal end 32*a*** of the tip 32. In this position, the blade can engage a slot such as the slot 20 in the screw 22.

When the blade 36 is bottomed in the slot 20, the distal end 32*a* of the screwdriver 10 is in contact with the top surface 22*a* of the screw 22. Preferably, the distal end is flat to enhance this contact.

When a screwdriver is used to install or remove a screw, it is normally pushed against the screw and turned at the same time to exert a force along the screw axis, while the screw is being turned.

Thus, when the blade 36 is in the slot 20 and the screwdriver 10 provided in accordance with this invention is pushed against the screw 22, a force is transmitted along the screw axis by the contact between the tip distal end 32*a* and the screw head surface 22*a*.

It is preferable that the blade 36 has a flat bottom surface 40 and that the side walls of the leading edge portion of the blade are flat to enhance its engagement in the rectangular screw slot 20. If desired, however, blades having other shapes can be used.

It is also preferred that the blade thickness is only very slightly less than the width of the slot 34 in which the blade slides. For example, it is most preferred that the blade is frictionally engaged to the walls of the slot.

When the blade and slot are sized, as described above, the permanence of the attachment of the blade to the sleeve is enhanced. For example, as can best be seen in FIG. 4, when the leading edge portion 36*a* of the blade 36 is in the screw slot 20, the remaining portion 36*b* of the blade remains in the tip segment slot 34. Forces exerted on the blade when the screw is turned, therefore, are in part transmitted to the tip segment 32. This inhibits the blade from being twisted loose from the sleeve.

When it is desired to place the shaft assembly in its configuration for use on a "PHILLIPS" head screw (best seen in FIGS. 2 and 5), the sleeve 38 is moved up the shaft 28 toward the handle 16. This places the blade in its retracted position housed within the slot 34 in the tip. Thus, the distal end of the blade, i.e., the leading edge portion 36*a*, no longer extends beyond the distal end 32*a* of the tip segment 32. In this configuration, the shaft tip segment 32 extends beyond the end 38*a* of the sleeve and can be inserted into the slots of the "PHILLIPS" head screw 26 to turn the screw.

The screwdriver shaft assembly 12 additionally comprises means to limit the travel of the sleeve 38 on the shaft 28.

In the preferred embodiment of FIGS. 1–5, the travel limiting means comprise an elongated annular recess 42 in the shaft between the tip segment 32 and the handle and a detent or dimple 44 which extends inwardly from the sleeve. The detent(s) 44 extends into the shaft annular recess 42 when the sleeve is on the shaft. The recess 42 and detent 44 are shown in dashed lines in FIGS. 4 and 5.

Although only one detent 44 is shown, more than one detent can be in the sleeve if desired.

When the shaft assembly 12 is in its configuration for operation on a single slot screw, the detent, as it is shown in FIG. 4, engages the distal flange 46 of the recess. Thus, in this configuration, the blade 36 is in its fully extended position with its leading edge 36*a* extending beyond the distal end 32*a* of the tip. The detent 44, when engaged with the flange 46, prohibits the sleeve and blade from being moved farther down the shaft and thus prohibits the sleeve from being removed from the shaft.

Figure 5:
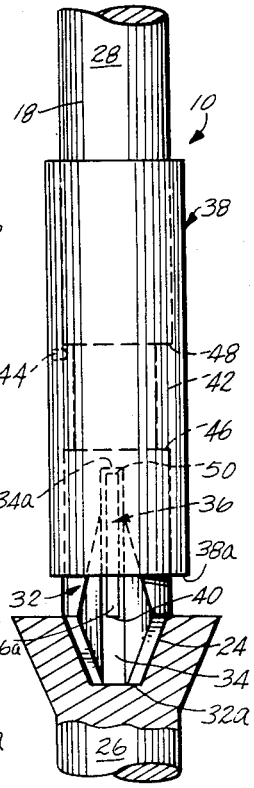
FIG. 5 is a fragmentary, semi-schematic side elevational view of the screwdriver of FIGS. 1 and 2 (in the configuration shown in FIG. 2) with its tip engaged in the slots of a cross-slotted screw.
Figure 3:
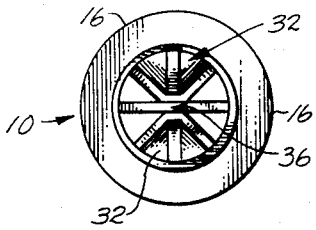
FIG. 3 is an end or tip view of the screwdriver of FIGS. 1 and 2.

When the shaft assembly is in its configuration for operation on a "PHILLIPS" head screw, the detent 44, as it is shown in FIG. 5, engages the proximal flange 48 of the recess. Preferably, the detent is positioned to contact the flange 48 at or before the proximal edge 50 of the blade contacts the bottom 34*a* of the slot 34. This prohibits forces from acting on the blade to drive it out of the sleeve.

Thus, the travel limiting means described above maintain the sleeve on the shaft, enhance the permanence of the connection between the blade and the sleeve, and provide for quick and easy placement of the blade in its desired position when the screwdriver is being used.

Referring now to FIGS. 6 and 7, there is shown another preferred embodiment of a screwdriver 110 provided in accordance with practice of this invention.

The screwdriver 110 comprises an elongated shaft assembly 112 having two ends; a first end 114 connected permanently to a handle 116 and a second end 118 remote from the handle. The shaft assembly 112 performs the same dual function as was performed by the shaft assembly 12 of the previously described preferred embodiment. Thus, when the assembly is in a first configuration (shown in FIG. 6), it can engage the single slot of a "standard" screw. Alternatively, when the assembly is in its second configuration (shown in FIG. 7), it can engage the slots of a cross-slotted or "PHILLIPS" head screw.

The shaft assembly 112 includes an elongated shaft 128 having a construction similar to the shaft 28 of the previous embodiment.

An elongated recess 130 is in the handle 116 along its axis. The recess has a smaller diameter section 130*a* in which the end 114 of the shaft is securely mounted or connected. Additionally, the recess comprises a larger diameter section 130*b* from which the shaft extends. An annular space 52 is defined between the shaft and the wall of the larger diameter section 130*b* of the recess.

The end of the elongated shaft 128 remote from the handle 116 comprises a shaft tip segment 132 identical to the shaft tip segment 32 described above. Thus, the tip segment 132 comprises an elongated slot 134 extending from the distal end 132*a* of the tip along its length.

The shaft assembly 112 also comprises a blade 136 which is slidably mounted in the elongated slot 134. In this embodiment, as was the case in the previous embodiment, the blade 136 is carried in an elongated hollow sleeve 138 which is open at both ends. The blade is fixedly connected across the distal opening or end 138*a* of the sleeve and the sleeve is slidably mounted on a shaft 128 for movement along the length of the shaft.

The sleeve 138 extends almost the entire length of the shaft and has a proximal portion 138*a* that is in the annular space 52. A spring 54 is around the elongated shaft 128 in the annular space 50. The spring 54 extends from the lip 56 formed by the transition of the larger diameter recess 130*b* to the smaller diameter recess 130*a*, to the bottom edge 58 of the proximal portion 138*a* of the sleeve.

The spring exerts a force on the sleeve to urge the sleeve away from the handle. Thus, in its normal configuration, as shown in FIG. 6, the blade 136 is in its fully extended position with its leading edge portion 136*a* extended beyond the distal end 132*a* of the shaft tip segment 132. In this configuration, the screwdriver 110 is in its configuration for use on a single slot or "standard" screw.

When it is desired to use the screwdriver 110 on a "PHILLIPS" head screw, the sleeve 138 is pulled back toward the handle against the force of the spring 54 so that the blade 136 is housed within the slot 134 in the tip segment 132 (best seen in FIG. 7).

In this preferred embodiment, an annular recess 142 similar to the recess 42 of the previous embodiment is in the shaft and a detent 144 similar to the detent 44 is in the sleeve. The detent and the recess comprise the means for limiting travel of the sleeve 138 on the shaft 128. Thus, the detent 144, by engaging the distal flange 146, maintains the sleeve 138 on the shaft and also, by the action of the spring, positions the blade in its proper position for use on a single slot screw. Additionally, the detent, by engaging the proximal flange 148 before the proximal edge 150 of the blade 136 contacts the bottom 134*a* of the slot 134, prohibits forces from acting on the blade to force it out of the sleeve.

If desired, travel limiting means, other than the detent and recess described above, can be used. For example, in another preferred embodiment, the travel limiting means comprise a slot (not shown) in the sleeve along a portion of its length and a pin (not shown) which extends from the surface of the shaft and which engages the slot.

Although this invention has been described in considerable detail with reference to certain versions thereof, it will be understood that variations and modifications can be effected within the spirit and scope of this invention described above and defined in the following claims.

What is claimed is:

1. A screwdriver for use both on a first type screw fastener having a configuration comprising a head with a single slot therein, and on a second type screw fastener having a configuration comprising a head having two slots therein crossing at about their centers, the screwdriver comprising:

a handle; and a shaft assembly comprising:

(a) an elongated shaft having one end mounted securely to the handle;

(b) the other end of the shaft comprising a tip segment for engagement of the slots in the head of such a second type fastener;

(c) an elongated slot in the shaft tip segment extending from the distal end of the tip segment along at least a portion of its length;

(d) an elongated hollow sleeve open at both ends slidably moounted on the shaft; and (e) a blade fixedly connected across the center of the distal opening of the elongated hollow sleeve, the blade mounted in the slot in the shaft tip segment for slidable movement in said slot when the sleeve is moved along the shaft and having a leading edge portion extending beyond the distal sleeve opening for engagement of the single slot in the head of such a first type fastener, the leading edge portion of the blade being in a first position extended beyond the distal end of the shaft tip segment for engagement of the slot of such a first type fastener when the sleeve is in a forward position relatively farther from the handle and the leading edge portion of the blade being in a second position housed within the elongated slot in the shaft tip segment when the sleeve is in a rearward position relatively nearer the handle so that said shaft tip segment can engage the slots of such a second type fastener.

2. The screwdriver according to claim 1 wherein the elongated slot in the shaft tip segment is in a plane about parallel to the axis of the shaft and is through about the center of the shaft.

3. The screwdriver according to claim 1 wherein the shaft assembly additionally comprises means for limiting travel of the elongated sleeve on the shaft.

4. The screwdriver according to claim 3 wherein the travel limiting means comprise:

(a) an elongated annular recess in the shaft between the shaft tip segment and the handle, the recess comprising a distal flange relatively farther from the handle and a proximal flange relatively nearer the handle; and (b) at least one detent in the surface of the elongated sleeve extending into the shaft annular recess when the sleeve is on the shaft, said detent engaging the distal flange when the blade is in its fully extended position with its leading edge portion extending beyond the distal end of the shaft tip segment.

5. The screwdriver according to claim 4 wherein the detent engages the proximal flange when the blade is fully retracted.

6. The screwdriver according to claim 1 additionally comprising:

(a) an elongated recess in the handle along the axis of said handle, wherein the elongated shaft extends from the recess and an annular space is defined by the shaft and the wall of the recess; and (b) a spring around the elongated shaft in the annular space defined by the shaft and the recess wall, said spring extending between the bottom of the annular space and the proximal end of the elongated sleeve for exerting a force on the sleeve to urge the sleeve away from the handle, thereby placing the blade in its first position with its leading edge portion extended beyond the distil end of the shaft tip segment.

7. The screwdriver according to claim 6 additionally comprising means for limiting travel of the sleeve along the shaft.

8. The screwdriver according to claim 7 wherein the travel limiting means comprise:

(a) an elongated annular recess in the shaft between the shaft tip segment and the handle, the recess comprising a distal flange relatively farther from the handle and a proximal flange relatively nearer the handle; and (b) at least one detent in the surface of the elongated sleeve extending into the shaft annular recess when the sleeve is on the shaft, said detent engaging the distal flange when the blade is in its fully extended position with its leading edge portion extending beyond the distal end of the shaft tip segment.

9. A screwdriver for use both on a first type screw fastener having a configuration comprising a head with a single slot therein, and on a second type screw fastener having a configuration comprising a head having two slots therein crossing at about their centers, the screwdriver comprising:

(a) a handle;

(b) an elongated shaft having one end mounted securely to the handle, the other end of said shaft comprising a tip segment for engagement of the slots in the head of such a second type fastener;

(c) an elongated slot in the shaft tip segment extending from the distal end of the tip segment along at least a portion of the length of said tip segment, the slot being in a plane about parallel to the axis of the shaft and through about the center of the shaft;

(d) an elongated annular recess in the shaft between the shaft tip segment and the handle, the recess comprising a distal flange relatively farther from the handle and a proximal flange relatively nearer the handle;

(e) an elongated sleeve open at both ends slidably mounted on the shaft for movement along the length of the shaft;

(f) a blade fixedly connected across the center of the distal opening of the sleeve, the blade mounted in the slot in the shaft tip segment for slidable movement in said slot when the sleeve is moved along the shaft and having a leading edge portion extending beyond the distal sleeve opening for engagement of the single slot in the head of such a first type fastener, the leading edge portion of the blade being in a first position extended beyond the distal end of the shaft tip segment for engagement of the slot of such a first type fastener when the sleeve is in a forward position relatively farther from the handle and the leading edge portion of the blade being in a second position housed within the elongated slot in the shaft tip segment when the sleeve is in a rearward position relatively nearer the handle so that said tip segment can engage the slots of such a second type fastener; and (g) at least one detent in the surface of the elongated sleeve extending into the shaft annular recess when the sleeve is on the shaft, said detent engaging the shaft recess distal flange when the blade is in its fully extended position with its leading edge portion extended beyond the distal end of the shaft tip segment.

10. A screwdriver for use both on a first type screw fastener having a configuration comprising a head with a single slot therein, and on a second type screw fastener having a configuration comprising a head having two slots therein crossing at about their centers, the screwdriver comprising:

(a) a handle;

(b) an elongated recess in the handle along the axis of said handle;

(c) an elongated shaft having one end mounted securely to the handle, said shaft extending from an annular space defined by the shaft and the wall of the recess, the other end of the shaft comprising a tip segment for engagement with the slots in the head of such a second type fastener;

(d) an elongated slot in the shaft tip segment extending from the distal end of the tip segment along at least a portion of its length, the slot being in a plane about parallel to the axis of the shaft and through about the center of said shaft;

(e) an elongated sleeve open at both ends slidably mounted on the elongated shaft for movement along the length of the shaft;

(f) a blade fixedly connected across the center of the distal opening of the sleeve, the blade mounted in the slot in the shaft tip segment for slidable movement in said slot when the sleeve is moved along the shaft and having a leading edge portion extending beyond the distal sleeve opening for engagement of the single slot in the head of such a first type fastener, the leading edge portion of the blade being in a first position extended beyond the distal end of the shaft tip segment for engagement of the slot of such a first type fastener when the sleeve is in a forward position relatively farther from the handle and the leading edge portion of the blade being in a second position housed within the elongated slot in the shaft tip segment when the sleeve is in a rearward position relatively nearer the handle so that said tip segment can engage the slots of such a second type fastener;

(g) a spring around the elongated shaft in the annular space defined by the shaft and recess wall, said spring being between the bottom of the annular space and the proximal end of the elongated sleeve for exerting a force on the sleeve to urge the sleeve away from the handle to thereby place the blade in its first position with its leading edge portion extended beyond the distal end of the shaft tip segment; and (h) means for limiting travel of the sleeve along the shaft.

11. The screwdriver according to claim 10 wherein the travel limiting means comprise:

(a) an elongated annular recess in the shaft between the shaft tip segment and the handle, the recess comprising a distal flange relatively farther from the handle and a proximal flange relatively nearer the handle; and (b) at least one detent in the surface of the elongated sleeve extending into the shaft annular recess when the sleeve is on the shaft, said detent engaging the distal flange when the blade is in its fully extended position with its leading edge portion extending beyond the distal end of the shaft tip segment.

12. A screwdriver shaft assembly for providing a screwdriver for use both on a first type screw fastener having a configuration comprising a head with a single slot therein, and on a second type screw fastener having a configuration comprising a head having two slots therein crossing at about their centers, the screwdriver shaft assembly comprising:

(a) an elongated shaft comprising a tip segment for engagement of the slots in the head of such a second type fastener;

(b) an elongated slot in the shaft tip segment extending from the end of the tip segment along at least a portion of the length of the shaft, the slot being in a plane about parallel to the axis of the shaft and through about the center of shaft;

(c) an elongated hollow sleeve open at both ends slidably mounted on the shaft at the end of the shaft near the tip segment; and (d) a blade fixedly connected across the sleeve opening adjacent the tip segment, the blade mounted in the slot in the tip segment for slidable movement in said slot when the sleeve is moved along the shaft and having a leading edge portion extending beyond the sleeve opening adjacent the tip segment for engagement of the slot in the head of such a first type fastener, the leading edge portion of the blade being in a first position extended beyond the end of the shaft tip segment for engagement of the slot of such a first type fastener when the sleeve is in a first position and the leading edge portion of the blade being in a second position housed within the elongated slot in the shaft tip segment when the sleeve is in a second position so that said tip segment can engage the slots of such a second type fastener.

13. The screwdriver shaft assembly according to claim 12 additionally comprising:

(a) an elongated annular recess in the shaft comprising a distal flange and a proximal flange; and (b) at least one detent in the surface of the elongated sleeve extending into the shaft annular recess when the sleeve is on the shaft, said detent engaging the distal flange when the blade is in its fully extended position with its leading edge portion extending beyond the distal end of the shaft tip segment.

* * * * *

UNITED STATES PATENT AND TRADEMARK OFFICE

CERTIFICATE OF CORRECTION

PATENT NO. : 4,488,462

DATED : December 18, 1984

INVENTOR(S) : Stanford J. Wall

It is certified that error appears in the above-identified patent and that said Letters Patent is hereby corrected as shown below:

Column 7, line 50, change "moounted" to --mounted--;

Signed and Sealed this

*Fourth* Day of *June 1985*

[SEAL]

*Attest:*

DONALD J. QUIGG

*Attesting Officer* *Acting Commissioner of Patents and Trademarks*